US011640808B2

(12) United States Patent
Cao

(10) Patent No.: US 11,640,808 B2
(45) Date of Patent: May 2, 2023

(54) ARRAY SUBSTRATE ROW DRIVE CIRCUIT UNIT, DRIVE CIRCUIT AND LIQUID CRYSTAL DISPLAY PANEL THEREOF

(71) Applicants: CHONGQING HKC OPTOELECTRONICS TECHNOLOGY CO., LTD., Chongqing (CN); HKC CORPORATION LIMITED, Shenzhen (CN)

(72) Inventor: Junhong Cao, Chongqing (CN)

(73) Assignees: CHONGQING HKC OPTOELECTRONICS TECHNOLOGY CO., LTD., Chongqing (CN); HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/561,988

(22) Filed: Dec. 26, 2021

(65) Prior Publication Data

US 2022/0122558 A1 Apr. 21, 2022

Related U.S. Application Data

(63) Continuation of application No. PCT/CN2020/098072, filed on Jun. 24, 2020.

(30) Foreign Application Priority Data

Jun. 27, 2019 (CN) ..... 201910573179.2

(51) Int. Cl.
*G09G 5/00* (2006.01)
*G09G 3/36* (2006.01)

(52) U.S. Cl.
CPC ... *G09G 3/3674* (2013.01); *G09G 2300/0408* (2013.01); *G09G 2310/08* (2013.01); *G09G 2320/0219* (2013.01)

(58) Field of Classification Search
CPC .. G09G 3/3611; G09G 3/3674; G09G 3/3677; G09G 2300/0408;
(Continued)

(56) References Cited

U.S. PATENT DOCUMENTS 8,860,651 B2 * 10/2014 Tseng ..... G11C 19/28 377/64
9,257,083 B2 * 2/2016 Dai ..... G09G 3/3648
(Continued)

FOREIGN PATENT DOCUMENTS

CN 104505036 A 4/2015
CN 104700814 A 6/2015
(Continued)

OTHER PUBLICATIONS

First Office Action issued in counterpart Chinese Patent Application No. 201910573179.2, dated Jan. 5, 2021.
(Continued)

*Primary Examiner* — Joe H Cheng
(74) *Attorney, Agent, or Firm* — Westbridge IP LLC

(57) ABSTRACT

Disclosed are an array substrate row drive circuit unit, a drive circuit and a liquid crystal display panel thereof. The array substrate row drive circuit unit includes a pull-up control module; a pull-up module; a pull-down module connected to the pull-up control module and the pull-up module and being configured to simultaneously pull down a pull-up control signal and a row scan signal of a current stage array substrate row drive circuit unit to a low level according to a direct current low voltage signal when receiving the row scan signal; and a voltage dividing module
(Continued)

electrically connected to the pull-up module and being configured to increase a falling edge during pull-down when the pull-down module simultaneously pulls down the pull-up control signal and the row scan signal of the current stage array substrate row drive circuit unit to a low level.

17 Claims, 3 Drawing Sheets

(58) Field of Classification Search
CPC ..... G09G 2310/0286; G09G 2310/08; G09G 2320/0219
See application file for complete search history.

(56) References Cited

U.S. PATENT DOCUMENTS

| | | | | |
|---|---|---|---|---|
| 9,483,992 | B2 * | 11/2016 | Xiao | G11C 19/287 |
| 9,805,680 | B2 * | 10/2017 | Xiao | G09G 3/3677 |
| 11,151,954 | B2 * | 10/2021 | Cao | G09G 3/3677 |
| 2005/0127369 | A1 | 6/2005 | Toya | |
| 2008/0048712 | A1 * | 2/2008 | Ahn | H03K 17/161 326/21 |
| 2008/0266275 | A1 * | 10/2008 | Tsai | G09G 3/3677 345/204 |
| 2010/0188385 | A1 * | 7/2010 | Boiko | G11C 19/184 377/68 |
| 2011/0157123 | A1 | 6/2011 | Cho | |
| 2011/0234577 | A1 * | 9/2011 | Yang | G11C 19/28 377/79 |
| 2012/0140871 | A1 * | 6/2012 | Yang | G09G 3/20 377/79 |
| 2014/0035889 | A1 * | 2/2014 | Huang | G09G 3/3674 345/204 |
| 2014/0103983 | A1 * | 4/2014 | Chang | H03K 3/015 327/198 |
| 2014/0159997 | A1 * | 6/2014 | Chen | G09G 3/3677 345/87 |
| 2015/0185520 | A1 * | 7/2015 | Xu | G02F 1/133514 327/108 |
| 2016/0182048 | A1 | 6/2016 | Shin et al. | |
| 2016/0284295 | A1 * | 9/2016 | Dai | G09G 3/3648 |
| 2017/0092215 | A1 | 3/2017 | Chang et al. | |
| 2017/0236480 | A1 * | 8/2017 | Dai | G09G 3/3677 345/213 |
| 2018/0004329 | A1 | 1/2018 | So et al. | |
| 2018/0151141 | A1 | 5/2018 | Gong | |
| 2020/0066203 | A1 * | 2/2020 | Kim | G09G 3/3233 |
| 2020/0219428 | A1 * | 7/2020 | Yuan | G09G 3/20 |
| 2020/0357341 | A1 * | 11/2020 | Xue | G09G 3/003 |

FOREIGN PATENT DOCUMENTS

| | | | | |
|---|---|---|---|---|
| CN | 104700899 | A | 6/2015 | |
| CN | 103325350 | B | 11/2015 | |
| CN | 107086022 | A | 8/2017 | |
| CN | 104700789 | B | 10/2017 | |
| CN | 108230989 | A | 6/2018 | |
| CN | 109559674 | A | 4/2019 | |
| CN | 109935185 | A | 6/2019 | |
| CN | 110335572 | A | 10/2019 | |
| JP | 2015518625 | A | 7/2015 | |
| JP | 2017530379 | A | 10/2017 | |
| JP | 2018511071 | A | 4/2018 | |
| KR | 20060010543 | A | 2/2006 | |
| WO | 2009013697 | A1 | 1/2009 | |
| WO | WO-2016106847 | A1 * | 7/2016 | G09G 3/20 |

OTHER PUBLICATIONS

International Search Report and Written Opinion issued in corresponding PCT Application No. PCT/CN2020/098072, dated Sep. 28, 2020.
Notification to Grant Patent Right for Invention issued in counterpart Chinese Patent Application No. 201910573179.2, dated Aug. 4, 2021.
Examination Report issued in counterpart Indian Patent Application No. 202227000918, dated Jun. 23, 2022.
Decision to Grant a Patent issued in counterpart Japanese Patent Application No. 2021-577963, dated Dec. 13, 2022.
Partial Supplementary European Search Report issued in counterpart European Patent Application No. 20832248.7, dated Dec. 19, 2022.

* cited by examiner

ARRAY SUBSTRATE ROW DRIVE CIRCUIT UNIT, DRIVE CIRCUIT AND LIQUID CRYSTAL DISPLAY PANEL THEREOF

CROSS-REFERENCE TO RELATED APPLICATIONS

This application is a continuation application of International Application No. PCT/CN2020/098072, filed on Jun. 24, 2020, which claims priority to Chinese Patent Application No. 201910573179.2, filed on Jun. 27, 2019, and entitled "ARRAY SUBSTRATE ROW DRIVE CIRCUIT UNIT, DRIVE CIRCUIT AND LIQUID CRYSTAL DISPLAY PANEL THEREOF", the entire disclosures of which are incorporated herein by reference.

TECHNICAL FIELD

The present disclosure relates to the field of display technology, and in particular to an array substrate row drive circuit unit, a drive circuit and a liquid crystal display panel thereof.

BACKGROUND

The following statements only provide information related to the present disclosure, and do not necessarily constitute prior art.

Gate Driver on Array (GOA) technology is an array substrate row drive technology, which uses the original array manufacturing process of the liquid crystal display panel to fabricate the drive circuit of the horizontal scan line on the substrate around the display area, so that it can replace the external integrated circuit (IC) board to complete the driving of the horizontal scan line. GOA technology can reduce the bonding process of external ICs, and has the opportunity to increase production capacity and reduce product costs, and can make LCD panels more suitable for manufacturing narrow-frame or borderless display products.

In the related art, part of the external integrated circuit (Gate IC) for gate drive can output the output signal waveform with two falling edges to reduce the feed-through voltage, but it is not suitable for GOA circuits. The GOA circuit in the related art can only output an output signal with one falling edge. Before and after the gate of the Thin Film Transistor (TFT) is turned off, the constant voltage high potential (VGH) is directly reduced to the constant voltage low potential (VGL). In addition, the feed-through voltage during charging of the pixels of the liquid crystal display panel cannot be reduced, which is not conducive to improving the display uniformity of the liquid crystal panel.

SUMMARY

The present disclosure provides an array substrate row drive circuit unit, an array substrate row drive circuit is formed by cascading multiple stages of array substrate row drive circuit units, the array substrate row drive circuit unit includes:

a pull-up control module for outputting a pull-up control signal when receiving a DC high voltage signal and a stage transmission signal;

a pull-up module electrically connected to the pull-up control module, and for outputting a row scan signal of the array substrate row drive circuit unit of a current stage when receiving the pull-up control signal and a high-frequency clock signal;

a pull-down module connected to the pull-up control module and the pull-up module, and for simultaneously pulling down the pull-up control signal and the row scan signal of the array substrate row drive circuit unit of the current stage to a low level according to a DC low voltage signal when receiving the row scan signal; and a voltage dividing module electrically connected to the pull-up module, and for increasing a falling edge during pull-down when the pull-down module simultaneously pulls down the pull-up control signal and the row scan signal of the array substrate row drive circuit unit of the current stage to the low level.

The present disclosure further provides an array substrate row drive circuit, the array substrate row drive circuit includes multiple stages of array substrate row drive circuit units, and the multiple stages of the array substrate row drive circuit units are cascaded to form the array substrate row drive circuit, each of the array substrate row drive circuit units charges a corresponding stage of horizontal scan lines in a display area, and each of the array substrate row drive circuit units includes:

a pull-up control module for outputting a pull-up control signal when receiving a DC high voltage signal and a stage transmission signal;

a pull-up module electrically connected to the pull-up control module, and for outputting a row scan signal of the array substrate row drive circuit unit of a current stage when receiving the pull-up control signal and a clock signal;

a plurality of pull-down modules, each of the pull-down modules is connected to a low-frequency signal, the pull-up control module, the pull-up module, and a DC low voltage signal, the plurality of pull-down modules are for simultaneously pulling down the pull-up control signal and the row scan signal of the array substrate row drive circuit unit of the current stage to a low level according to the DC low voltage signal when receiving the row scan signal; and a voltage dividing module electrically connected to the pull-up module, and for increasing a falling edge during pull-down when the pull-down module simultaneously pulls down the pull-up control signal and the row scan signal of the array substrate row drive circuit unit of the current stage to the low level.

The present disclosure further provides a liquid crystal display panel, the liquid crystal display panel includes an integrated circuit and an array substrate row drive unit, an output terminal of the integrated circuit is electrically connected with the array substrate row drive unit, the array substrate row drive circuit includes multiple stages of array substrate row drive circuit units, and the multiple stages of the array substrate row drive circuit units are cascaded to form the array substrate row drive circuit, the array substrate row drive circuit unit charges a corresponding stage of horizontal scan lines in a display area, and the array substrate row drive circuit unit includes:

a pull-up control module for outputting a pull-up control signal when receiving a DC high voltage signal and a stage transmission signal;

a pull-up module electrically connected to the pull-up control module, and for outputting a row scan signal of the array substrate row drive circuit unit of a current stage when receiving the pull-up control signal and a high-frequency clock signal;

a plurality of pull-down modules, each of the pull-down modules is connected to a low-frequency signal, the pull-up control module, the pull-up module, and a DC low voltage signal, the plurality of pull-down modules are for simultaneously pulling down the pull-up control signal and the row scan signal of the array substrate row drive circuit unit of the current stage to a low level according to the DC low voltage signal when receiving the row scan signal; and a voltage dividing module electrically connected to the pull-up module, and for increasing a falling edge during pull-down when the pull-down module simultaneously pulls down the pull-up control signal and the row scan signal of the array substrate row drive circuit unit of the current stage to the low level.

In technical solutions of the present disclosure, when receiving the row scan signal, the pull-down module simultaneously pulls down the pull-up control signal and the row scan signal of the array substrate row drive circuit unit of the current stage to a low level according to the DC low voltage signal. During the process of pulling down, the voltage dividing module is increased. Through the voltage dividing function of the voltage dividing module, when the pull-down module pulls down the pull-up control signal and the row scan signal of the array substrate row drive circuit unit of the current stage to a low level simultaneously, the number of falling edges is increased, such that the row scan signal descends stepwise, and the waveform output by the array substrate row drive circuit unit of the current stage has two falling edges, to reduce the difference between the high potential and the low potential, and reduce the feed-through voltage of the pixel, thereby improving the uniformity of the liquid crystal display panel.

BRIEF DESCRIPTION OF THE DRAWINGS

In order to more clearly illustrate the embodiments of the present disclosure, drawings used in the embodiments will be briefly described below. Obviously, the drawings in the following description are only some embodiments of the present disclosure. It will be apparent to those skilled in the art that other figures can be obtained according to the structures shown in the drawings without creative work.

Figure 1:
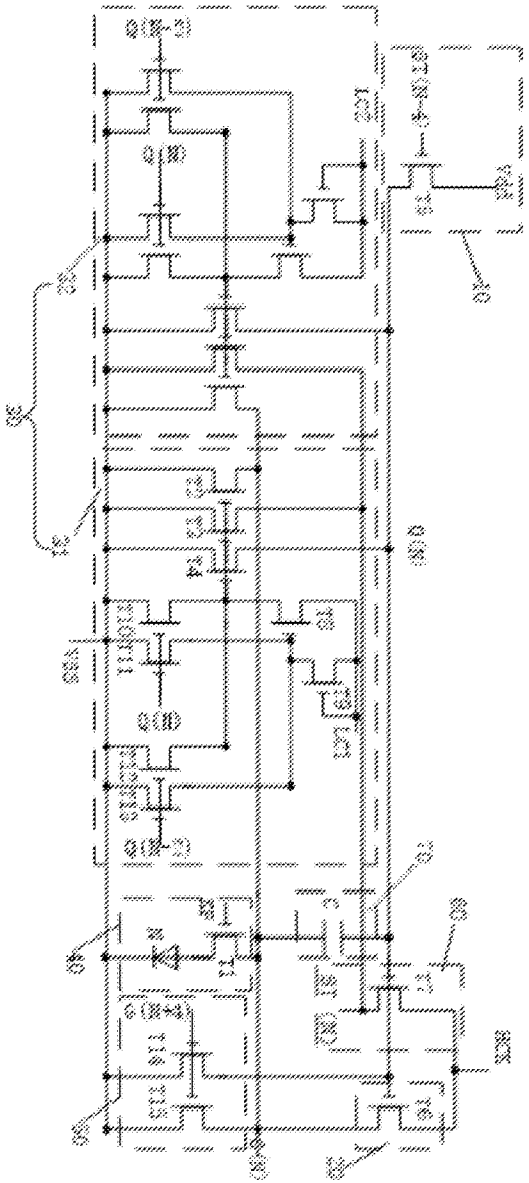
FIG. 1 is a schematic diagram of modules of an array substrate row drive circuit unit of the present disclosure.

The realization of the objective, functional characteristics, and advantages of the present disclosure are further described with reference to the accompanying drawings.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that if there is a directional indication (such as up, down, left, right, front, rear . . . ) in the embodiments of the present disclosure, the directional indication is only used to explain the relative positional relationship, movement, etc. of the components in a certain posture (as shown in the drawings). If the specific posture changes, the directional indication will change accordingly.

Besides, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. In addition, the technical solutions between the various embodiments can be combined with each other, but they must be based on the realization of those of ordinary skill in the art. When the combination of technical solutions is contradictory or cannot be achieved, it should be considered that such a combination of technical solutions does not exist, nor is it within the scope of the present disclosure.

Figure 2:
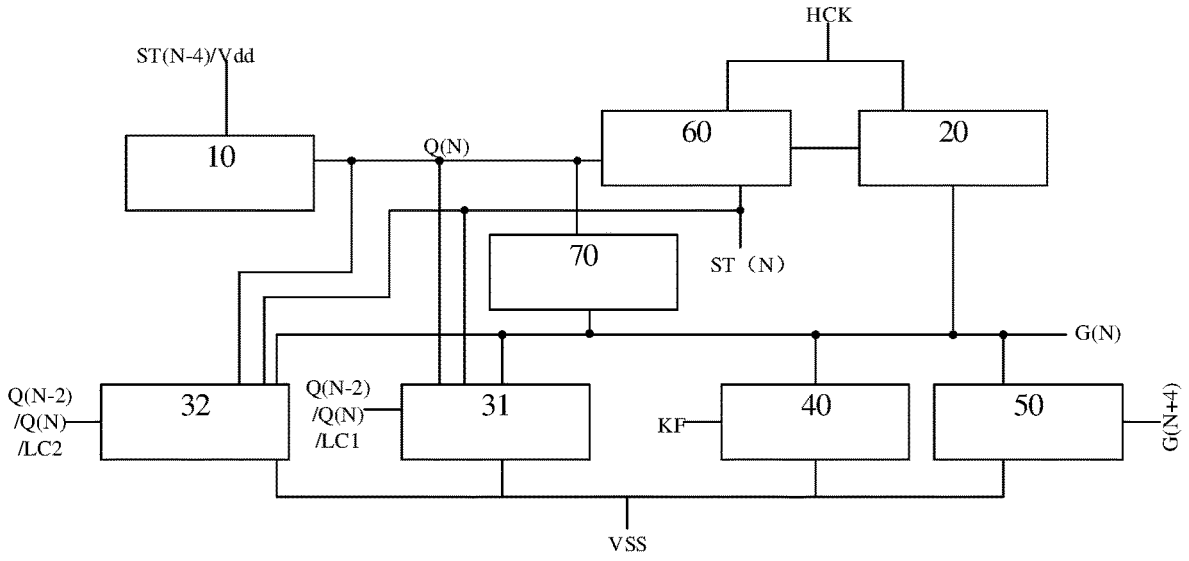
FIG. 2 is a schematic circuit diagram of the array substrate row drive circuit unit of the present disclosure.
Figure 3:
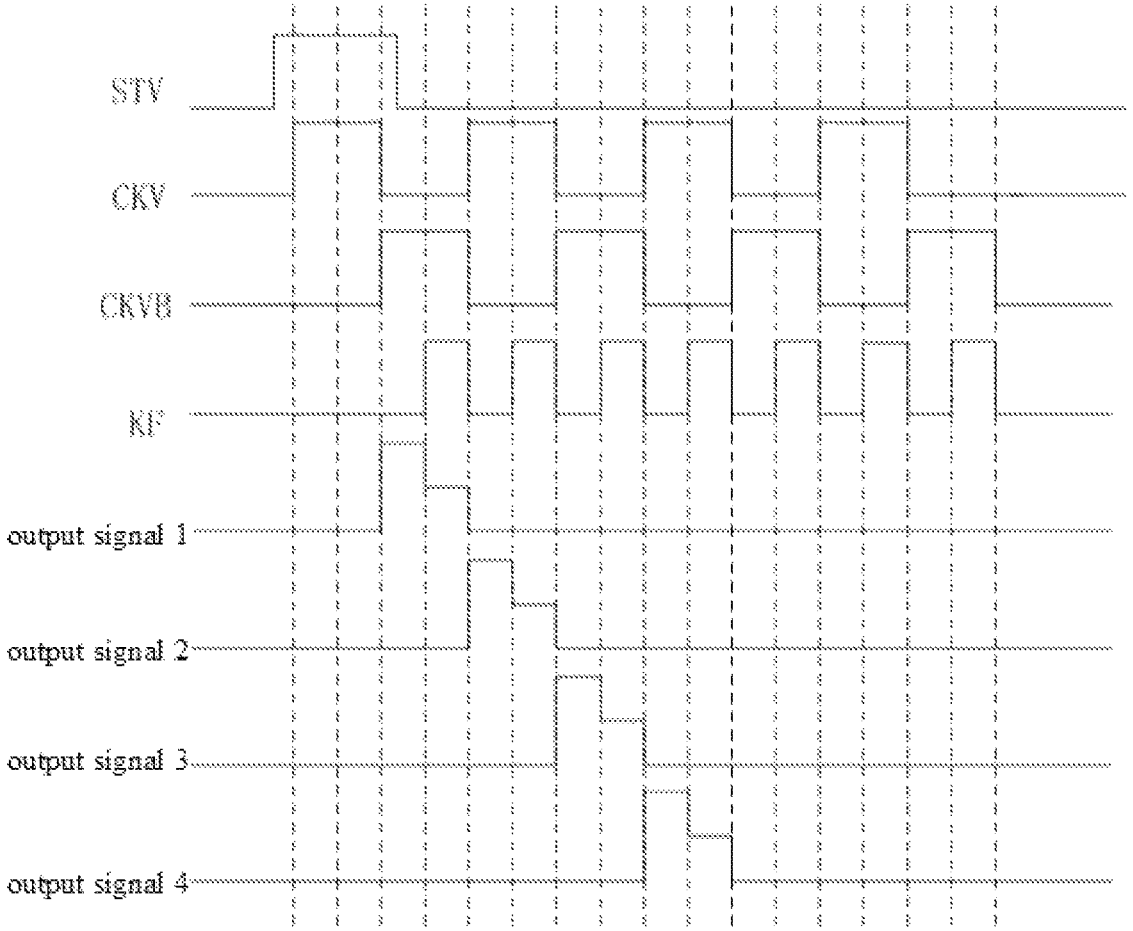
FIG. 3 is a timing diagram of the array substrate row drive circuit unit of the present disclosure.

As shown in FIG. 1 to FIG. 3, the present disclosure provides an array substrate row drive circuit unit, an array substrate row drive circuit is formed by cascading multiple stages of array substrate row drive circuit units, the array substrate row drive circuit unit includes:

a pull-up control module 10 for outputting a pull-up control signal Q(N) when receiving a direct current (DC) high voltage signal Vdd and a stage transmission signal;

a pull-up module 20 electrically connected to the pull-up control module 10, and for outputting a row scan signal G(N) of the array substrate row drive circuit unit of a current stage when receiving the pull-up control signal Q(N) and a high-frequency clock signal HCK;

a pull-down module 30 connected to the pull-up control module 10 and the pull-up module 20, and for simultaneously pulling down the pull-up control signal Q(N) and the row scan signal G(N) of the array substrate row drive circuit unit of the current stage to a low level according to a DC low voltage signal VSS when receiving the row scan signal G(N); and a voltage dividing module 40 electrically connected to the pull-up module 20, and for increasing a falling edge during pull-down when the pull-down module 30 simultaneously pulls down the pull-up control signal Q(N) and the row scan signal G(N) of the array substrate row drive circuit unit of the current stage to the low level.

Since the array substrate row drive circuit is formed by cascading multiple stages of array substrate row drive circuit units, the array substrate row drive circuit unit of the current stage charges the corresponding stage of horizontal scan lines in the display area. As shown in FIG. 1 and FIG. 3, the pull-up control module 10 includes a fifth field effect transistor T5, a source of the fifth field effect transistor T5 is connected to a row scan signal G(N)Q(N−4) of a first array substrate row drive circuit unit, a gate of the fifth field-effect transistor T5 is connected to a stage transmission signal ST(N−4) of the first array substrate row drive circuit unit, and a drain of the fifth field effect transistor T5 outputs a pull-up control signal Q(N) of the array substrate row drive circuit unit of the current stage. It should be noted that the stage transmission signal is a signal transmitted by the cascaded multi-stage array substrate row drive circuit step by step for turning on the array substrate row drive circuit, so as to realize the step-by-step scanning of the gate. In this embodiment, the stage transmission signal refers to the signal transmitted from the array substrate row drive circuit unit of the previous stage to the array substrate row drive circuit unit of the current stage. If the array substrate row drive circuit unit of the current stage is a first-stage array substrate row drive circuit unit, then a gate of the fifth field effect transistor T5 receives an initial signal STV, generates the first clock signal CKV signal, the second clock signal CKVB, and the improved STV signal that is the STVP signal through the initial signal STV and other signals, and outputs the pull-up control signal Q(N). As shown in FIG. 3, the initial signal STV is responsible for activating the first-stage array substrate row drive circuit unit. If the array substrate row drive circuit unit of the current stage is not the first-stage array substrate row drive circuit unit, then the gate of the fifth field effect transistor T5 receives the stage transmission signal ST(N−4) of the first array substrate row drive circuit unit, and outputs the pull-up control signal Q(N) of the array substrate row drive circuit unit of the current stage according to the received stage transmission signal ST(N−4) and DC high voltage signal Vdd of the first array substrate row drive circuit unit. The array substrate row drive circuit unit of the current stage is activated by the row scan signal G(N)Q(N−4) of the first array substrate row drive circuit unit and the stage transmission signal ST(N−4) of the first array substrate row drive circuit unit, thereby the array substrate row drive circuit is turned on step by step, realizing row scan driving, so that the horizontal scan lines can be charged step by step.

The pull-up module 20 is electrically connected to the pull-up control module 10, and receives the pull-up control signal Q(N) and the clock signal HCK output by the pull-up control module 10, and outputs the row scan signal G(N) of the array substrate row drive circuit unit of the current stage according to the pull-up control signal Q(N) and the clock signal HCK. The pull-up module 20 includes a sixth field effect transistor T6, a source of the sixth field effect transistor T6 is connected to the clock signal HCK, a gate of the sixth field effect transistor T6 is electrically connected to a pull-up control signal Q(N) output by the pull-up control module 10 of the current stage, and a drain of the sixth field effect transistor T6 outputs the row scan signal G(N) of the array substrate row drive circuit unit of the current stage.

As shown in FIG. 1, the array substrate row drive circuit unit further includes a stage transmission module 60. The stage transmission module 60 is electrically connected to the pull-up control module 10. The stage transmission module 60 includes a seventh field effect transistor T7, a source of the seventh field effect transistor T7 is connected to the clock signal HCK, a gate of the seventh field effect transistor T7 and the sixth field effect transistor T6 of the pull-up module 20 are connected to each other, and are connected to the pull-up control signal Q(N) output by the pull-up control module 10, a drain of the seventh field effect transistor T7 is for outputting a stage transmission signal ST(N) of the array substrate row drive circuit unit of the current stage, and the seventh field effect transistor T7 outputs the received clock signal HCK as the stage transmission signal ST(N) of the array substrate row drive circuit unit of the current stage synchronized with the row scan signal G(N) of the array substrate row drive circuit unit of the current stage according to the pull-up control signal Q(N) of the current stage.

The pull-down module 30 is electrically connected to the pull-up control module 10 and the pull-up module 20. When receiving the row scan signal G(N) output by a second array substrate row drive circuit unit Q(N−2), the pull-down module 30 pulls down the pull-up control signal Q(N) output by the pull-up control module 10 and the row scan signal G(N) of the array substrate row drive circuit unit of the current stage to a low level simultaneously according to the DC low voltage signal VSS, such that the pull-up control signal Q(N) output by the pull-up control module 10 and the row scan signal G(N) of the array substrate row drive circuit unit of the current stage are maintained in a closed state. The pull-down module 30 includes a second field effect transistor T2, a third field effect transistor T3, and a fourth field effect transistor T4. A source of the second field effect transistor T2, a source of the third field effect transistor T3, and a source of the fourth field effect transistor T4 are respectively connected to a DC low voltage signal VSS. A gate of the second field effect transistor T2, a gate of the third field effect transistor T3, and a gate of the fourth field effect transistor T4 are electrically connected to each other. A drain of the second field effect transistor T2 is electrically connected to one end of the pull-up module 20 that outputs the row scan signal G(N) of the array substrate row drive circuit unit of the current stage. A drain of the third field effect transistor T3 is electrically connected to the stage transmission signal output by the stage transmission module 60. A drain of the fourth field effect transistor T4 is electrically connected to one end of the pull-up control module 10 that outputs the pull-up control signal Q(N).

The voltage dividing module 40 is electrically connected to the pull-up module 20 and connected to the DC low voltage signal VSS, and increases the number of falling edges when the row scan signal is pulled down according to a falling edge generation signal KF when the pull-down module 30 pulls down the pull-up control signal Q(N) and the row scan signal G(N) of the array substrate row drive circuit unit of the current stage to a low level simultaneously, such that the row scan signal descends stepwise. FIG. 3 illustrates a GOA with a 4 CLK structure, which outputs 4 rows of scan signals. It can also be a GOA with an 8 CLK structure in the present disclosure, and GOA with other structures can also be applied. In this embodiment, the outputted four line scan signals 1-4 all have two falling edges, and the falling mode is in a stepped manner. Compared with the related GOA technology which contains only one falling edge, the number of falling edges is increased. The step-like descending method further reduces the difference between VGH and VGL, so as to reduce the feed-through voltage of the pixels, thereby improving the uniformity of the liquid crystal display panel. The voltage dividing module 40 includes an electronic component and a voltage divider, and the voltage divider can be a diode component. The first terminal of the electronic component is for receiving the falling edge generation signal KF. The second terminal of the electronic component is electrically connected to the pull-up module 20, so that the falling edge of the row scan signal output by the pull-up module 20 increases. The third terminal of the electronic component is for receiving the DC low voltage signal VSS through the voltage divider. It should be noted that the falling edge generation signal KF is a signal generated by the control falling edge output by the integrated circuit.

It should be noted that the second array substrate row drive circuit unit is an array substrate row drive circuit unit located at the previous stage of the current stage array substrate row drive circuit unit. The first array substrate row drive circuit unit is an array substrate row drive circuit unit located at the previous stage of the second array substrate row drive circuit unit.

In technical solutions of the present disclosure, when receiving the row scan signal G(N), the pull-down module 30 simultaneously pulls down the pull-up control signal Q(N) and the row scan signal G(N) of the array substrate row drive circuit unit of the current stage to a low level according to the DC low voltage signal VSS. During the process of pulling down, the voltage dividing module 40 is added. Through the voltage dividing function of the voltage dividing module 40, when the pull-down module 30 pulls down the pull-up control signal Q(N) and the row scan signal G(N) of the array substrate row drive circuit unit of the current stage to a low level simultaneously, the number of falling edges is increased, such that the row scan signal descends stepwise, and the waveform output by the array substrate row drive circuit unit of the current stage has two falling edges, to reduce the difference between the high potential and the low potential, and reduce the feed-through voltage of the pixel, thereby improving the uniformity of the liquid crystal display panel.

In an embodiment, an electronic component is the first field effect transistor T1, a gate of the first field effect transistor T1 is for receiving the falling edge generation signal KF, a drain of the first field effect transistor T1 is for receiving a DC low voltage signal VSS through the voltage divider, a source of the first field effect transistor T1 is electrically connected to the pull-up module 20 to increase the number of falling edges of the row scan signal G(N) output by the pull-up module 20.

When receiving the falling edge generation signal KF, the first field effect transistor T1 increases the number of falling edges of the row scan signal during the process of pulling down according to the falling edge generation signal KF when the pull-down module 30 pulls down the pull-up control signal Q(N) and the row scan signal G(N) of the array substrate row drive circuit unit of the current stage to a low level simultaneously. It should be noted that the first field effect transistor T1 can also be a thin film transistor, the voltage divider is a diode, a positive electrode of the voltage divider is connected to the drain of the first field effect transistor T1, and a negative electrode of the voltage divider is connected to the DC low voltage signal VSS. Since the diode has the technical feature that only allows current to flow in a single direction, if the current flows in the reverse direction, the diode will be turned off, when the input falling edge generation signal KF is high, the signal output from the first field effect transistor T1 is high, the voltage divider can turn on the signal output by the first field effect transistor T1 to input the DC low voltage signal VSS. When the input falling edge generation signal KF is low, the signal output by the first field effect transistor T1 is low, and the diode cannot be turned on.

In an embodiment, as shown in FIG. 1 to FIG. 2, the array substrate row drive circuit unit includes two pull-down modules 30, and both pull-down modules 30 are electrically connected to the pull-up control module 10 and the pull-up module 20.

In order to increase the service life of the components, the two pull-down modules 30 are driven in turn to slow down the damage of the components and increase the service life of the components. The number and connection methods of the components in the two pull-down modules 30 are the same. The difference is that the low-frequency signals connected to the two pull-down modules 30 are different. The two pull-down modules 30 are divided into a first pull-down module 31 and a second pull-down module 32. The first pull-down module 31 is connected to the first low-frequency signal LC1, and the first pull-down module 31 is simultaneously connected to the pull-up control module 10, the pull-up module 20, and the DC low voltage signal VSS. According to the first low frequency signal LC1 and the DC low voltage signal VSS, the pull-up control signal Q(N) and the row scan signal G(N) of the current stage are maintained in the off state. The second pull-down module 32 is connected to the second low-frequency signal LC2, and the second pull-down module 32 is simultaneously connected to the pull-up control module 10, the pull-up module 20, and the DC low voltage signal VSS. According to the second low-frequency signal LC2 and the DC low voltage signal VSS, the pull-up control signal Q(N) and the row scan signal G(N) of the current stage are maintained in the off state.

It should be noted that when the first low-frequency signal LC1 is connected to the first pull-down module 31, it needs to flow through the ninth field effect transistor T9 and the eighth field effect transistor body T8. A drain of the eighth field effect transistor body T8 is connected to the gate of the second field effect transistor T2, the gate of the third field effect transistor T3 and the gate of the fourth field effect transistor T4. A source and gate of the ninth field effect transistor T9 and the source of the eighth field effect transistor body T8 are simultaneously connected to the first low-frequency signal LC1. A drain of the ninth field effect transistor T9 is connected to the gate of the eighth field effect transistor body T8. The circuit connection mode of the second pull-down module 32 is the same as the circuit connection mode of the first pull-down module 31.

In an embodiment, as shown in FIG. 1 to FIG. 2, the first pull-down module 31 further includes a tenth field effect transistor T10, an eleventh field effect transistor T11, a twelfth field effect transistor T12, and a thirteenth field effect transistor T13. A source of the tenth field effect transistor T10, a source of the eleventh field effect transistor T11, a source of the twelfth field effect transistor T12, and a source of the thirteenth field effect transistor T13 are simultaneously connected to the DC low voltage signal VSS. A gate of the tenth field effect transistor T10 and a gate of the eleventh field effect transistor T11 are connected to each other, and are connected to the pull-up control signal Q(N) output by the pull-up control unit of the current stage. A drain of the tenth field effect transistor T10 and a drain of the eighth field effect transistor body T8 simultaneously connect with the gate of the second field effect transistor T2, the gate of the third field effect transistor T3, and the gate of the fourth field effect transistor T4. A drain of the eleventh field effect transistor T11 is connected to the drain of the ninth field effect transistor T9. A gate of the twelfth field effect transistor T12 and the gate of the thirteenth field effect transistor T13 are connected to each other, and are connected to the pull-up control signal Q(N-2). A drain of the twelfth field effect transistor T12 is connected to the drain of the ten field effect transistor and the drain of the eighth field effect transistor body T8. A drain of the thirteenth field effect transistor T13 is connected to the drain of the eleventh field effect transistor T11 and the drain of the ninth field effect transistor T9.

In an embodiment, the array substrate row drive circuit unit further includes a pull-down holding module 50 electrically connected to the pull-up module 20 and the pull-up control module 10.

As shown in FIG. 1 and FIG. 2, the pull-down holding module 50 is connected to the pull-up control module 10, the pull-up module 20 and the DC low voltage signal VSS. When receiving the row scan signal G(N+4) output by the pull-up module of the third array substrate row drive circuit unit, the pull-up control signal Q(N) of the current stage and the row scan signal G(N) of the current stage are maintained in the off state according to the row scan signal G(N+4) and the DC low voltage signal VSS output by the pull-up module of the third array substrate row drive circuit unit.

In an embodiment, the pull-down holding module includes a fourteenth field effect transistor T14 and a fifteenth field effect transistor T15. A gate of the fourteenth field effect transistor T14 and a gate of the fifteenth field effect transistor T15 are connected to each other, and are connected to the row scan signal G(N+4) output by the pull-up module of the third array substrate row drive circuit unit. A source of the fourteenth field effect transistor T14 and a source of the fifteenth field effect transistor T15 are simultaneously connected to the DC low voltage signal VSS. A drain of the fourteenth field effect transistor T14 is connected to the pull-up control signal Q(N) output by the pull-up control module 10 of the current stage. A drain of the fifteenth field effect transistor T15 is connected to the row scan signal G(N) output by the pull-up module 20 of the current stage.

It should be noted that the third array substrate row drive circuit unit is an array substrate row drive circuit unit located at the next stage of the array substrate row drive circuit unit of the current stage. In an embodiment, as shown in FIG. 1 and FIG. 2, the array substrate row drive circuit unit further includes a bootstrap module 70, one end of the bootstrap module 70 is electrically connected to one end of the pull-up control module 10 that outputs the pull-up control signal Q(N), and another end of the bootstrap module 70 is electrically connected to one end of the row scan signal G(N) of the array substrate row drive circuit unit of the current stage output by the pull-up module 20.

The bootstrap module 70 includes a bootstrap capacitor, one end of the bootstrap capacitor is electrically connected to the end of the pull-up control module 10 that outputs the pull-up control signal Q(N), and another end of the bootstrap capacitor is electrically connected to one end of the row scan signal G(N) of the array substrate row drive circuit unit of the current stage output by the pull-up module 20. The bootstrap capacitor is mainly to maintain the voltage between the gate and the source of the sixth field effect transistor T6 to stabilize the output of the sixth field effect transistor T6.

In summary, the present disclosure provides an array substrate row drive circuit unit, an array substrate row drive circuit is formed by cascading multiple stages of array substrate row drive circuit units, the array substrate row drive circuit unit includes:

a pull-up control module for outputting a pull-up control signal when receiving a DC high voltage signal and a stage transmission signal;

a pull-up module electrically connected to the pull-up control module, and for outputting a row scan signal when receiving the pull-up control signal and a high-frequency clock signal;

a pull-down module connected to the pull-up control module and the pull-up module, and for pulling down the pull-up control signal and the row scan signal to a low level according to a DC low voltage signal when receiving the row scan signal; and a voltage dividing module electrically connected to the pull-up module, and for increasing a falling edge during pull-down when the pull-down module pulls down the pull-up control signal and the row scan signal to the low level.

The present disclosure further provides an array substrate row drive circuit. The array substrate row drive circuit includes multiple stages of array substrate row drive circuit units as described above. The specific circuit of the array substrate row drive circuit unit refers to the above-mentioned embodiment. Since the array substrate row drive circuit adopts all the technical solutions of all the above-mentioned embodiments, it has at least all the beneficial effects brought by the technical solutions of the above-mentioned embodiments, which will not be repeated here. The array substrate row drive circuit is formed by cascading multiple stages of array substrate row drive circuit units. Compared with only one falling edge in the prior art, in the present disclosure, the number of falling edges of the output scan signal is increased, and the difference between the high potential VGH and the low potential VGL of the output row scan signal is reduced, thereby reducing the feed-through voltage of the pixels, improving the uniformity of the liquid crystal display panel, which is beneficial to the display of the liquid crystal display panel with a narrow frame.

As shown in FIG. 1 to FIG. 3, the present disclosure further provides a liquid crystal display panel. The liquid crystal display panel includes an integrated circuit and the array substrate row drive circuit as described above. The specific circuit of the array substrate row drive circuit refers to the above-mentioned embodiments. Since the liquid crystal display panel adopts all the technical solutions of all the above-mentioned embodiments, it has at least all the beneficial effects brought by the technical solutions of the above-mentioned embodiments, which will not be repeated here. The output terminal of the integrated circuit is electrically connected to the gate of the first field effect transistor T1 in the circuit unit of the array substrate row drive circuit. The integrated circuit outputs the signal generated by the control falling edge, the first field effect transistor T1 determines whether the diode in the circuit unit of the array substrate row drive circuit is turned on according to the received falling edge generation signal KF. When receiving the falling edge generation signal KF, the first field effect transistor T1 increases the number of falling edges of the row scan signal according to the falling edge generation signal KF when the pull-down module 30 pulls down the pull-up control signal Q(N) and the row scan signal G(N) of the array substrate row drive circuit unit of the current stage to a low level simultaneously, thus the waveform output by the array substrate row drive circuit unit of the current stage has two falling edges, to reduce the difference between the high potential VGH and the low potential VGL and reduce the feed-through voltage of the pixels, thereby improving the uniformity of the liquid crystal display panel, which is beneficial to the display of the liquid crystal display panel with a narrow frame.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. An array substrate row drive circuit unit, wherein an array substrate row drive circuit is formed by cascading multiple stages of array substrate row drive circuit units, the array substrate row drive circuit unit comprises:

a pull-up control module for outputting a pull-up control signal when receiving a direct current (DC) high voltage signal and a stage transmission signal;

a pull-up module electrically connected to the pull-up control module, and for outputting a row scan signal of the array substrate row drive circuit unit of a current stage when receiving the pull-up control signal and a high-frequency clock signal;

a pull-down module connected to the pull-up control module and the pull-up module, and for simultaneously pulling down the pull-up control signal and the row scan signal of the array substrate row drive circuit unit of the current stage to a low level according to a DC low voltage signal when receiving the row scan signal; and a voltage dividing module electrically connected to the pull-up module, and for increasing a falling edge during pull-down when the pull-down module simultaneously pulls down the pull-up control signal and the row scan signal of the array substrate row drive circuit unit of the current stage to the low level.

2. The array substrate row drive circuit unit of claim 1, wherein the voltage dividing module comprises an electronic component and a voltage divider, a first terminal of the electronic component is for receiving a falling edge generation signal, a second terminal of the electronic component is connected to the pull-up module to receive the row scan signal output by the pull-up module, and a third terminal of the electronic component is for receiving the DC low voltage signal through the voltage divider.

3. The array substrate row drive circuit unit of claim 2, wherein an electronic component is a first field effect transistor, a gate of the first field effect transistor is for receiving a falling edge generation signal, a source of the first field effect transistor is electrically connected to the pull-up module to receive the row scan signal output by the pull-up module, and a drain of the first field effect transistor is for receiving the DC low voltage signal through the voltage divider.

4. The array substrate row drive circuit unit of claim 1, wherein the array substrate row drive circuit unit comprises two pull-down modules, and the two pull-down modules are electrically connected to the pull-up control module and the pull-up module.

5. The array substrate row drive circuit unit of claim 1, wherein the array substrate row drive circuit unit further comprises:

a pull-down holding module electrically connected to the pull-up module and the pull-up control module.

6. The array substrate row drive circuit unit of claim 1, wherein the array substrate row drive circuit unit further comprises a bootstrap module, one end of the bootstrap module is electrically connected to one end of the pull-up control module that outputs the pull-up control signal, and another end of the bootstrap module is electrically connected to one end of the row scan signal of the array substrate row drive circuit unit of the current stage output by the pull-up module.

7. The array substrate row drive circuit unit of claim 1, wherein the array substrate row drive circuit unit further comprises a stage transmission module electrically connected to the pull-up control module.

8. The array substrate row drive circuit unit of claim 7, wherein the pull-down module comprises a second field effect transistor, a third field effect transistor, and a fourth field effect transistor, a source of the second field effect transistor, a source of the third field effect transistor, and a source of the fourth field effect transistor are respectively connected to a DC low voltage signal, a gate of the second field effect transistor, a gate of the third field effect transistor, and a gate of the fourth field effect transistor are electrically connected to each other, a drain of the second field effect transistor is electrically connected to one end of the pull-up module that outputs the row scan signal of the array substrate row drive circuit unit of the current stage, a drain of the third field effect transistor is electrically connected to the stage transmission signal output by the stage transmission module, and a drain of the fourth field effect transistor is electrically connected to one end of the pull-up control module that outputs the pull-up control signal.

9. An array substrate row drive circuit, wherein the array substrate row drive circuit comprises multiple stages of array substrate row drive circuit units, and the multiple stages of the array substrate row drive circuit units are cascaded to form the array substrate row drive circuit, each of the array substrate row drive circuit units charges a corresponding stage of horizontal scan lines in a display area, and each of the array substrate row drive circuit units comprises:

a pull-up control module for outputting a pull-up control signal when receiving a DC high voltage signal and a stage transmission signal;

a pull-up module electrically connected to the pull-up control module, and for outputting a row scan signal of the array substrate row drive circuit unit of a current stage when receiving the pull-up control signal and a clock signal;

a plurality of pull-down modules, each of the pull-down modules is connected to a low-frequency signal, the pull-up control module, the pull-up module, and a DC low voltage signal, the plurality of pull-down modules are for simultaneously pulling down the pull-up control signal and the row scan signal of the array substrate row drive circuit unit of the current stage to a low level according to the DC low voltage signal when receiving the row scan signal; and a voltage dividing module electrically connected to the pull-up module, and for increasing a falling edge during pull-down when the pull-down module simultaneously pulls down the pull-up control signal and the row scan signal of the array substrate row drive circuit unit of the current stage to the low level.

10. The array substrate row drive circuit of claim 9, wherein the array substrate row drive circuit unit further comprises a stage transmission module, and the stage transmission module is electrically connected to the pull-up control module.

11. The array substrate row drive circuit of claim 10, wherein the pull-down module comprises a second field effect transistor, a third field effect transistor, and a fourth field effect transistor, a source of the second field effect transistor, a source of the third field effect transistor, and a source of the fourth field effect transistor are respectively connected to a DC low voltage signal, a gate of the second field effect transistor, a gate of the third field effect transistor, and a gate of the fourth field effect transistor are electrically connected to each other, a drain of the second field effect transistor is electrically connected to one end of the pull-up module that outputs the row scan signal of the array substrate row drive circuit unit of the current stage, a drain of the third field effect transistor is electrically connected to the stage transmission signal output by the stage transmission module, and a drain of the fourth field effect transistor is electrically connected to one end of the pull-up control module that outputs the pull-up control signal.

12. The array substrate row drive circuit of claim 11, wherein the pull-up control module comprises a fifth field effect transistor, a source of the fifth field effect transistor is connected to a row scan signal of a first array substrate row drive circuit unit, a gate of the fifth field-effect transistor is connected to a stage transmission signal of the first array substrate row drive circuit unit, and a drain of the fifth field effect transistor outputs a pull-up control signal of the array substrate row drive circuit unit of the current stage.

13. The array substrate row drive circuit of claim 12, wherein the pull-up module comprises a sixth field effect transistor, a source of the sixth field effect transistor is connected to the clock signal, a gate of the sixth field effect transistor is electrically connected to a pull-up control signal output by the pull-up control module of the current stage, and a drain of the sixth field effect transistor outputs the row scan signal.

14. The array substrate row drive circuit of claim 13, wherein the stage transmission module comprises a seventh field effect transistor, a source of the seventh field effect transistor is connected to the clock signal, a gate of the seventh field effect transistor and the sixth field effect transistor of the pull-up module are connected to each other, and are connected to the pull-up control signal output by the pull-up control module, a drain of the seventh field effect transistor is for outputting a stage transmission signal of the array substrate row drive circuit unit of the current stage, and the seventh field effect transistor outputs the received clock signal as the stage transmission signal of the array substrate row drive circuit unit of the current stage synchronized with the row scan signal of the array substrate row drive circuit unit of the current stage according to the pull-up control signal of the current stage.

15. A liquid crystal display panel, wherein the liquid crystal display panel comprises an integrated circuit and an array substrate row drive circuit unit, an output terminal of the integrated circuit is electrically connected with the array substrate row drive circuit unit, the array substrate row drive circuit comprises multiple stages of array substrate row drive circuit units, and the multiple stages of the array substrate row drive circuit units are cascaded to form the array substrate row drive circuit, the array substrate row drive circuit unit charges a corresponding stage of horizontal scan lines in a display area, and the array substrate row drive circuit unit comprises:

a pull-up control module for outputting a pull-up control signal when receiving a DC high voltage signal and a stage transmission signal;

a pull-up module electrically connected to the pull-up control module, and for outputting a row scan signal of the array substrate row drive circuit unit of a current stage when receiving the pull-up control signal and a high-frequency clock signal;

a plurality of pull-down modules, each of the pull-down modules is connected to a low-frequency signal, the pull-up control module, the pull-up module, and a DC low voltage signal, the plurality of pull-down modules are for simultaneously pulling down the pull-up control signal and the row scan signal of the array substrate row drive circuit unit of the current stage to a low level according to the DC low voltage signal when receiving the row scan signal; and a voltage dividing module electrically connected to the pull-up module, and for increasing a falling edge during pull-down when the pull-down module simultaneously pulls down the pull-up control signal and the row scan signal of the array substrate row drive circuit unit of the current stage to the low level.

16. The liquid crystal display panel of claim 15, wherein the voltage dividing module comprises an electronic component and a voltage divider, a first terminal of the electronic component is for receiving a falling edge generation signal, a second terminal of the electronic component is connected to the pull-up module to receive the row scan signal output by the pull-up module, and a third terminal of the electronic component is for receiving the DC low voltage signal through the voltage divider.

17. The liquid crystal display panel of claim 16, wherein the electronic component is a thin film transistor, a gate of the thin film transistor is for receiving the falling edge generation signal, a source of the thin film transistor is electrically connected to the pull-up module to receive the row scan signal output by the pull-up module, a drain of the thin film transistor is for receiving the DC low voltage signal through the voltage divider, and the voltage divider is a diode component.

* * * * *